US009694474B2

(12) United States Patent
Branaman

(10) Patent No.: US 9,694,474 B2
(45) Date of Patent: Jul. 4, 2017

(54) DEBURRING TOOL

(71) Applicant: Danny Branaman, Carlsbad, TX (US)

(72) Inventor: Danny Branaman, Carlsbad, TX (US)

( * ) Notice: Subject to any disclaimer, the term of this patent is extended or adjusted under 35 U.S.C. 154(b) by 0 days.

(21) Appl. No.: 14/592,371

(22) Filed: Jan. 8, 2015

(65) Prior Publication Data

US 2015/0231461 A1 Aug. 20, 2015

Related U.S. Application Data

(60) Provisional application No. 61/939,834, filed on Feb. 14, 2014.

(51) Int. Cl.

| | |
|---|---|
| ***B24D 15/00*** | (2006.01) |
| ***B24D 15/04*** | (2006.01) |
| ***B24D 15/02*** | (2006.01) |
| ***A63B 47/04*** | (2006.01) |
| ***A63B 57/00*** | (2015.01) |
| *A63B 57/20* | (2015.01) |

(52) U.S. Cl.

CPC ..... *B24D 15/04* (2013.01); *A63B 47/04* (2013.01); *A63B 57/00* (2013.01); *B24D 15/02* (2013.01); *A63B 57/20* (2015.10)

(58) Field of Classification Search

CPC ..... B24D 15/04; B24D 15/02; B24D 15/023; A63B 47/04; A63B 57/00; A63B 57/20; A63B 47/00; A63B 47/002; A63B 47/043; A41D 19/01594

USPC ..... 451/523; 15/21.2; 206/315.9, 514; 220/656, 657, 659

See application file for complete search history.

(56) References Cited

U.S. PATENT DOCUMENTS

| | | | | | |
|---|---|---|---|---|---|
| 667,272 | A * | 2/1901 | Webster | B24D 15/023 | 451/522 |
| 1,041,958 | A * | 10/1912 | Buckau | B28B 7/0029 | 249/104 |
| 1,617,838 | A * | 2/1927 | Fennell | B24D 13/147 | 15/230 |
| 1,936,312 | A * | 11/1933 | Snyder | B65D 61/00 | 206/525 |
| 2,329,054 | A * | 9/1943 | Kapp | A45D 26/0004 | 451/523 |
| 2,665,571 | A * | 1/1954 | Lochead | A47G 19/28 | 211/14 |

(Continued)

FOREIGN PATENT DOCUMENTS

DE 10227329 * 8/2004

*Primary Examiner* — George Nguyen

(74) *Attorney, Agent, or Firm* — Global Intellectual Property Agency, LLC; Daniel Boudwin

(57) ABSTRACT

A deburring tool for removing scuffs, scratches and burrs from golf balls. The tool includes a circular, planar top portion with a rim around the perimeter thereof and a sidewall that is connected to the perimeter that extends therefrom in an outward and flared manner. The sidewall provides a top and a bottom, wherein the top and the bottom provide a circular perimeter. The bottom of the sidewall has a beveled edge adapted to fit the contours and curvatures of a golf ball and can be placed thereon for the removal of scuffs, scratches and burrs therefrom. A loop is connected to the perimeter of the planar top portion through which a chain can be inserted thereto for attachment to a purse, bag and the like. The planar top portion and sidewall form a unitary structure defining an interior volume having an open bottom.

8 Claims, 2 Drawing Sheets

(56) References Cited

U.S. PATENT DOCUMENTS 2,723,508 A * 11/1955 Haworth ..... B24D 15/02 451/164
2,782,854 A * 2/1957 Muhlbach ..... B26D 1/44 408/204
2,895,452 A * 7/1959 Angeloff ..... B24D 15/00 30/455
2,942,387 A * 6/1960 Lindblad ..... B24D 7/10 451/548
3,024,578 A * 3/1962 Mushkin ..... B24B 11/10 451/268
3,989,079 A * 11/1976 Treadway ..... B24D 15/02 30/494
3,998,012 A * 12/1976 Ness ..... B24D 15/04 15/118
4,424,601 A * 1/1984 Weber ..... A21C 11/106 30/302
4,494,650 A * 1/1985 Cullen ..... A63B 47/00 206/315.9
4,683,681 A * 8/1987 Russ, III ..... B24D 5/165 451/343
4,757,571 A * 7/1988 Young ..... A46B 5/00 132/76.4
4,779,387 A 10/1988 Reid
4,785,586 A * 11/1988 Kratfel ..... B24D 15/02 30/494
4,894,958 A 1/1990 Takasaki
5,101,718 A * 4/1992 Lin ..... A23N 4/18 30/302
5,484,329 A * 1/1996 Engelbrektson ..... B24B 11/02 451/50
5,611,723 A 3/1997 Mitoma
5,658,188 A 8/1997 Yamada
5,769,141 A * 6/1998 Rinehard ..... A63B 60/62 150/160
6,129,611 A * 10/2000 Yamaguchi ..... B24B 11/10 451/278
6,296,558 B1 * 10/2001 Poole ..... B24D 15/023 451/515
6,485,379 B2 * 11/2002 Fondin ..... A45F 5/00 206/315.9
6,571,414 B1 * 6/2003 Krenzler ..... A63B 47/04 451/559
6,991,527 B2 * 1/2006 Linzell ..... B05C 17/002 451/523
7,892,073 B1 * 2/2011 Smania ..... B24B 11/10 15/21.2
8,469,773 B2 6/2013 Ono
2002/0177818 A1 * 11/2002 Vaillancourt ..... A61M 5/3273 604/198
2004/0033770 A1 * 2/2004 Tchernov ..... B24D 15/02 451/523
2007/0251096 A1 * 11/2007 Smith ..... A47J 43/14 30/120.5
2010/0031462 A1 * 2/2010 Hassfurther ..... A63B 47/04 15/210.1
2010/0087265 A1 * 4/2010 Rolando ..... A63B 47/02 473/132
2010/0113974 A1 * 5/2010 Williams ..... A61B 10/02 600/570
2012/0256431 A1 * 10/2012 Moriarty ..... A63B 57/00 294/19.2
2013/0225310 A1 * 8/2013 Gardiner ..... A63B 47/02 473/285

* cited by examiner

DEBURRING TOOL

CROSS REFERENCE TO RELATED APPLICATION

This application claims the benefit of U.S. Provisional Application No. 61/939,834 filed on Feb. 14, 2014. The above identified patent application is herein incorporated by reference in its entirety to provide continuity of disclosure.

BACKGROUND OF THE INVENTION

Field of the Invention

The present invention relates to deburring tools. More specifically the invention relates to a deburring tool having sidewalls, a beveled edge and an interior volume, wherein the device is adapted to fit the contours and curvatures of a golf ball for the removal of scuff, scratches and the like therefrom.

When playing golf, it is important to employ accurate swinging technique in addition to having a proper stance and posture when swinging a golf club. Further, many other factors such as the type of golf club used and the golf ball may affect the performance and score of a golfer. Golf balls often develop scuff, burrs, scratches which can greatly affect the aerodynamic properties of the ball and result in a skewed flight path which can be quite frustrating and lead to a poor score.

Conventional deburring tools are not portable and often include heavy machinery or require an electrical power source. Thus, a user is required to transport his or her golf ball to a location where the deburring tool is located, wherein the deburring process can take a period of time to complete. This however, is impractical and inefficient as it does not enable a user to quickly remove the scratches, scuff and burrs on a golf ball while on a golf course.

Accordingly, the present invention relates to a new and improved deburring tool that can be easily transported and provides a planar top portion connected to a unitary sidewall, wherein the lower end of the sidewall provides a beveled edge and extends downward in a flared manner. The invention forms an interior volume and can be placed over top of a golf ball, wherein the beveled edge thereof can rest against and contact the exterior surface of the golf ball to which the user can then employ a rotating motion in order to remove scuff, burrs, scratches and other marks therefrom.

Description of the Prior Art

Devices have been disclosed in the prior art that relate to deburring tools. These include devices that have been patented and published in patent application publications. These devices generally relate to deburring tools for removing scuffs, scratches, and the like from a standard golf ball. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 5,658,188 to Yamada provides a method for grinding the surface of a golf ball and removing the thin outer layer thereof, wherein the device comprises grinding tools having a grinding face which can grind the outer surface of a golf ball via three axes. This device however, does not provide a portable deburring tool that can be placed on top of the exterior surface of a golf ball, wherein the user can employ a rotating motion in order to remove scuff and the like therefrom.

U.S. Pat. No. 8,469,773 to Ono discloses a device for deburring a ball that includes a rotating holder in which the ball can be placed, and wherein an abrasive surface can remove burrs from the ball. The device further provides an electronic control and a cam. While this device may be helpful in the removal of burrs, the present invention allows a user to remove burrs from a golf ball without requiring the use of batteries, electrical components, or moving parts to provide an easy to use apparatus.

U.S. Pat. No. 4,779,387 to Reid describes a method and apparatus for automatically buffing a golf ball that provides an automatic buffing machine for buffing a golf ball, wherein the device includes a flash ring, a blade, and a cutting station. In contrast, the present invention offers an easy to use construction that is lightweight and less cumbersome to use and transport and does not require the use of multiple movable parts in order to effectively remove burrs, marks and scuffs from a golf ball.

U.S. Pat. No. 4,894,958 to Seiichi allows for an apparatus that enables users to scrape off burrs that are present on a golf ball. The device accomplishes such a task via a machine comprising a plurality of spindles, a drive wheel, a pivoting spring, shafts an upper arm and various other movable parts and components. The present invention provides a deburring tool that accomplishes the removal of burrs and the like from the exterior surface of a golf ball via the use of manual manipulation of the deburring tool and does not include of heavy, movable parts.

These prior art devices have several known drawbacks. The above discussed devices do not provides a handheld device that can be manually maneuvered by the user in order to remove scuff, scratches, and burrs from a golf ball via a beveled edge. The deburring tool of the present invention is adapted to conform to the contours and curvature of a golf ball to readily remove marks therefrom, wherein the beveled edge of the deburring tool in its entirety can rest on the outer surface of a golf ball at all times when placed thereon top. In light of the devices disclosed in the prior art, it is submitted that the present invention substantially diverges in design elements from the prior art and consequently it is clear that there is a need in the art for an improvement to existing deburring devices. In this regard the instant invention substantially fulfills these needs.

SUMMARY OF THE INVENTION

In view of the foregoing disadvantages inherent in the known types of deburring apparatuses now present in the prior art, the present invention provides a new deburring tool wherein the same can be utilized for providing convenience for the user when removing scratches, scuffs, marks and burrs from a golf ball.

It is therefore an object of the present invention to provide a new and improved deburring device that has all of the advantages of the prior art and none of the disadvantages.

It is another object of the present invention to provide a deburring apparatus that is adapted to fit the contours and curvature of a golf ball.

Another object of the present invention is to provide a deburring apparatus that can be easily transported in a pocket, purse, and the like.

Another object of the present invention is to provide a deburring apparatus having a removably attached key chain for securement to a bag, purse and the like.

Yet another object of the present invention is to provide a deburring tool that can be easily cleaned.

Yet another object of the present invention is to provide a deburring tool that can be manually manipulated in order to remove scuffs and burrs from a golf ball.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
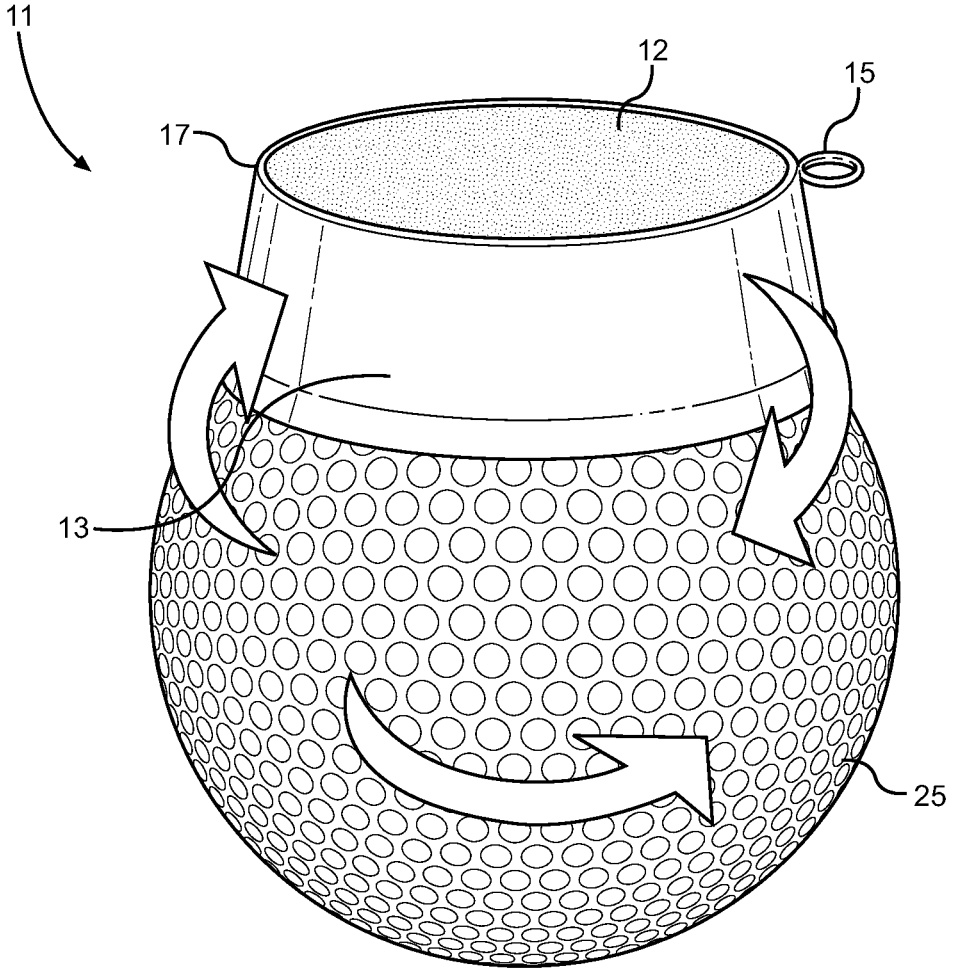
FIG. 1 shows a front view of the deburring tool of the present invention as used to clean a golf ball.

Reference is made herein to the attached drawings. Like reference numerals are used throughout the drawings to depict like or similar elements of the deburring tool. For the purposes of presenting a brief and clear description of the present invention, the preferred embodiment will be discussed as used for removing scuffs, burrs and the like from golf balls. The figures are intended for representative purposes only and should not be considered to be limiting in any respect.

Referring now to FIG. 1, there is shown a front view of the deburring tool 11 having a planar top portion 12 and a sidewall 13 extending downward therefrom. The top portion 12 is preferably substantially circular. The sidewall 13 is connected to the perimeter of the top portion 12 and extends outwardly therefrom in a flared manner forming an open bottom and defining an interior volume. Thus, the open bottom is wider than the top portion 12 and the sidewall 13 tapers towards the top portion 12 of the deburring tool 11. The sidewall 13 comprises a unitary structure having a beveled edge, wherein the beveled edge forms the perimeter thereof. The top portion 12 provides a rim that comprises a slightly raised lip that is located therearound the perimeter of the top. The beveled edge is such that it extends outwardly from the sidewall and forms a slight slant therefrom, wherein the slant extends from the exterior to the interior portion of the deburring tool. The deburring tool 11 provides a first side and a second side, wherein the first side is the exterior thereof and the second side is the interior thereof.

The top portion 12 of the deburring tool 11 provides a loop 15 attached thereto. The loop 15 is preferably unitary therewith. The user can insert a chain through the loop 15 for securement to a golf bag, a purse, a keychain or various other locations. The loop 15 can further be used as an aid for gripping and transporting the deburring tool 11, wherein the user can place the thumb and forefinger onto the loop 15 in order to easily grasp the deburring tool 11 in its entirety.

The deburring tool 11 is made from aluminum in a preferred embodiment, however the deburring tool 11 can be made from other materials such as plastic, stainless steel, iron, rubber, and/or other suitable materials. Aluminum however, is the preferred material as it is somewhat pliable and able to be manipulated as such that it more readily conforms to the contours and curvatures of a golf ball. The material from which the deburring tool is constructed can be more than one material, wherein the exterior or the deburring tool can be aluminum and the interior of the deburring tool can be felt, rubber, or a fabric material for removing scuff, scratches and burrs from a golf ball.

Figure 2:
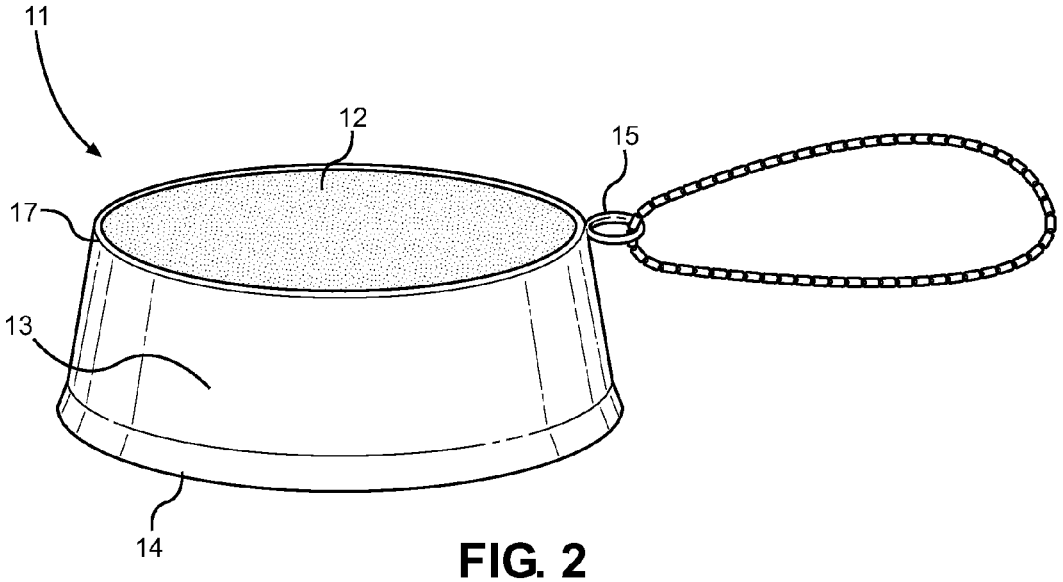
FIG. 2 shows a view of the deburring tool of the present invention.

FIG. 2 shows a view of the deburring tool 11 having a planar top portion 12 and a unitary wall that outwardly extends therefrom in a flared manner, wherein the beveled edge 14 is placed on a golf ball to remove burrs and scuffs therefrom. The user can manually grasp the sidewall of the deburring tool 11 and place the open bottom end of the deburring tool 11 over top of a golf ball, wherein the beveled edge 14 contacts the surface of the golf ball and is adapted to conform to the contours and curvature of the golf ball and thus fits comfortably thereover.

The beveled edge 14 contacts the surface of the golf ball at all times when placed thereon, wherein no open spaces are formed between the golf ball and the beveled edge 14 of the deburring tool 11 when placed into contact with one another. The user can then manually rotate the deburring tool 11, wherein the beveled edge rubs along the surface of the golf ball in various directions in order to remove burrs, scuff, scratches and the like therefrom. Further, the beveled edge 14 of the deburring tool 11 can be straight if desired and is not limited to a beveled structure.

Figure 3:
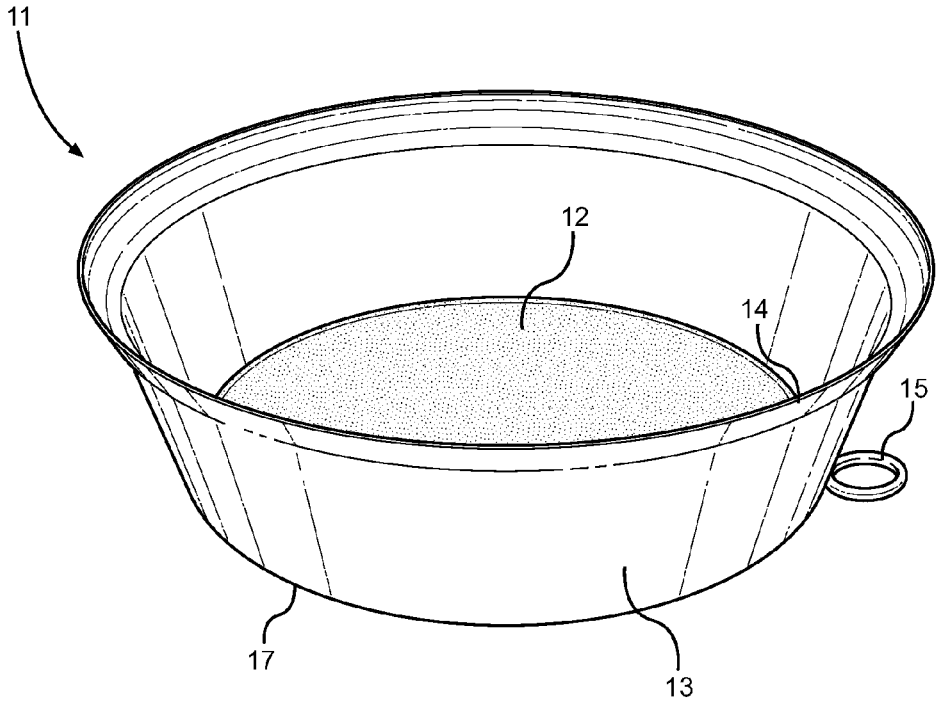
FIG. 3 shows an overhead view of the interior of the deburring tool in an inverted position.

FIG. 3 shows an overhead view of the interior of the deburring tool 11 in an inverted position. The deburring tool comprises an interior volume that is adapted to receive a portion of a golf ball therein. The planar top of the deburring tool 11 is not limited to a circular shape and can be square, rectangular, oval and/or other suitable shape. The sidewall 13 provides a top and a bottom, wherein the top forms a circular shaped perimeter and the bottom forms a circular shaped perimeter. The circular shaped perimeter of the bottom of the sidewall 13 comprises the beveled edge 14, wherein the beveled edge 14 is preferred as such that it provides a structure conducive to removing the scuff, scratches and burrs from a golf ball.

The beveled edge 14 is used to remove the scratches, scuffs, and burrs from a golf ball when placed on a golf ball, wherein the user manually employs a circular rotating motion to the outer surface of the golf ball, Further, the interior surface of the deburring tool 11 can provide a material that further assists in the removal of scuff, scratches and burrs from the outer surface of a gold ball, wherein the material can be felt, rubber and/or other suitable material.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A deburring tool, comprising:

a planar top portion having a perimeter;

a sidewall connected to said perimeter of said top portion and extending downward therefrom in a flared orientation defining an interior volume having an open bottom end adapted to fit the contours and curvature of a golf ball;

wherein said bottom end comprises a beveled edge.

2. The deburring tool of claim 1, wherein said top portion comprises a circular shape.

3. The deburring tool of claim 1, further comprising a rim, said rim extending along said perimeter of said top portion.

4. The deburring tool of claim 1, wherein said sidewall comprises a unitary body.

5. The deburring tool of claim 1, wherein said perimeter of said top portion further comprises a loop connected thereto.

6. The deburring tool of claim 1, wherein said deburring tool comprises an aluminum material.

7. The deburring tool of claim 6, wherein said interior volume includes a felt material therein.

8. The deburring tool of claim 1, wherein said deburring tool comprises a rubber material.

* * * * *